US005769966A

United States Patent [19]

Park

[11] Patent Number: 5,769,966

[45] Date of Patent: Jun. 23, 1998

[54] INSULATOR COATING FOR HIGH TEMPERATURE ALLOYS METHOD FOR PRODUCING INSULATOR COATING FOR HIGH TEMPERATURE ALLOYS

[75] Inventor: Jong Hee Park, Clarendon Hills, Ill.

[73] Assignee: The United States of America as represented by the Department of Energy, Washington, D.C.

[21] Appl. No.: 674,938

[22] Filed: Jul. 3, 1996

Related U.S. Application Data

[63] Continuation of Ser. No. 241,425, May 11, 1994, abandoned.

[51] Int. Cl.[6] ..... C23C 10/22; C23C 8/40

[52] U.S. Cl. ..... 148/242; 148/245

[58] Field of Search ..... 148/242, 277, 148/285, 245

[56] References Cited

U.S. PATENT DOCUMENTS

| | | | |
|---|---|---|---|
| 3,941,569 | 3/1976 | Sesame | 148/242 |
| 4,398,967 | 8/1983 | DeVan | 148/242 |
| 4,483,720 | 11/1984 | Bartlett | 148/277 |
| 4,555,275 | 11/1985 | Tobis | 148/277 |
| 4,654,237 | 3/1987 | Savitsky et al. . | |
| 4,935,073 | 6/1990 | Bartlett | 148/277 |
| 5,017,544 | 5/1991 | Ikegamic | 148/277 |
| 5,223,045 | 6/1993 | Priceman | 148/277 |

FOREIGN PATENT DOCUMENTS

| | | | |
|---|---|---|---|
| 2074063 | 4/1987 | Japan | 148/277 |

OTHER PUBLICATIONS

American Ceramic Society Bulletin vol. 71, No. 10, Oct. 1992.

E. Salpitro–ITER: Basic Device 12th Conference Proceedings, NICE, 12–19 Oct. 1988 International Atomic Energy Agency.

Fusion Reactor Materials, Semiannual Progress Report for Period Ending Sep. 30, 1992, U.S. Department of Energy.

Fusion Reactor Materials, Semiannual Progress Report for Period Ending Mar. 31, 1993, U.S. Department of Energy.

Measurement of Electrical Resistivity of Thermally Grown Titanium Nitride Thin Films in Liquid Lithium, Park et al. Oct. 1993.

*Primary Examiner*—Sam Silverberg
*Attorney, Agent, or Firm*—Joy Alwan; Thomas G. Anderson; William R. Moser

[57] ABSTRACT

A method for fabricating an electrically insulating coating on a surface is disclosed comprising coating the surface with a metal, and reacting the metal coated surface with a nonmetal so as to create a film on the metal-coated surface. Alternatively, the invention provides for a method for producing a noncorrosive, electrically insulating coating on a surface saturated with a nonmetal comprising supplying a molten fluid, dissolving a metal in the molten fluid to create a mixture, and contacting the mixture with the saturated surface. Lastly, the invention provides an electrically insulative coating comprising an underlying structural substrate coated with an oxide or nitride compound

9 Claims, 2 Drawing Sheets

INSULATOR COATING FOR HIGH TEMPERATURE ALLOYS METHOD FOR PRODUCING INSULATOR COATING FOR HIGH TEMPERATURE ALLOYS

This application is a continuation of application Ser. No. 08/241,425 filed May 11, 1994 , now abandoned.

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

1. Field of the Invention

The present invention relates to an improved insulator coating on the surface of a metal or alloy substrate and a method for providing an insulator coating on the metal or alloy substrate, and more specifically to an electrical insulator coating on a metal alloy substrate and an in-situ method of applying an electrical insulator coating on the surface of a metal alloy substrate.

2. Background of the Invention

Internal operating environments of some energy generation systems, such as the liquid metal cooling systems associated with fusion reactors and alkali metal thermal to electric converters (AMTEC), are quite extreme. Operating temperatures can reach as high as 750° C. As such, liquid metals must be utilized as coolant fluids for heat transfer. High temperature liquid metal containment systems typically involve molten lithium, sodium or sodium-potassium as coolants.

Corrosion resistance of structural materials and magnetohydrodynamic (MHD) force and its influence on thermal hydraulics and corrosion are major concerns in the design of liquid-metal blankets for magnetic fusion reactors. As such, insulator coatings are required on the inside structural surfaces of these devices. Typically, vanadium and stainless steel comprise these structural elements.

In the past, intermetallic films have been fabricated without regard to electrical resistivity. For example, U.S. Pat. No. 4,654,237 discloses a process for chemical and thermal treatment of steel work pieces to obtain intermetallic coatings by diffusive precipitation. Other past coatings and their methods of fabrication also centered around intermetallic film applications wherein the structural substrate is first placed into an inert atmosphere and then exposed to a vapor or liquid solution of the desired deposition metal, said metal first dissolved in a liquid-metal coolant such as liquid lithium. Because of their metal content, intermetallic coatings do not have all of the desired electrical insulator properties necessary to prevent the exertion of MHD forces on sensitive structures surrounding a fusion device. Furthermore the coatings produced by these methods tend to corrode when subjected to the high temperatures associated with fusion systems, AMTEC devices, and other liquid metal containment applications.

A need exists in the art for stable corrosion-resistance, electrical insulator coatings for in-situ application at the liquid-metal/structural-material interface and a method for producing the same. Said coating and method should enable the application of electrically insulating coatings to various and complex geometrical shapes such as the inside and outside of tubes and related structures. The resulting coatings must prevent adverse MHD-generated currents from passing through the structural walls of reactors or of other devices to effect nearby structures, said coatings also acting as diffusion barriers for hydrogen isotopes, viz., deuterium and tritium. Finally, the coatings and method should be easily applicable to commercial products with a minimum of down time or tool-up.

SUMMARY OF THE INVENTION

It is an object of the present invention to provide a method for producing a corrosion-resistant, electrical insulating layer for metal surfaces which overcome many of the disadvantages of the prior art.

It is another object of the present invention to provide a method for producing a corrosion-resistant coating for metal surfaces in high temperature environments. A feature of the invention is using liquid metal coolant to facilitate production of the coating. An advantage of the method is the in-situ repair of substrate surfaces in liquid metal coolant environments such as fusion reactors.

Yet another object of the present invention is to provide a method for producing an electrical insulator coating for metal surfaces. A feature of the invention is the fabrication of oxide- or nitride-coatings onto structural surfaces. An advantage of the invention is the prevention of magnetohydrodynamic-generated currents from passing through structural walls.

Still another object of the present invention is to provide an electrically insulating, corrosion-resistant coating for liquid metal containment devices. A feature of the invention is that the coating is applied via liquid or gas phase deposition. An advantage of the invention is the production of defect-free coatings on irregular-shaped surfaces and configurations.

Briefly, the invention provides for a method for producing an electrically insulating coating on a surface comprising forming an intermetallic layer on the surface and reacting the intermetallic layer with a nonmetal so as to create a coating on the metal-coated surface. In addition, the invention provides for a method for producing a noncorrosive, electrically insulating coating on a surface saturated with a nonmetal, comprising supplying a molten fluid, dissolving a metal in the molten fluid to create a mixture, and contacting the mixture with the nonmetal-saturated surface.

The invention also provides an electrically insulating coating comprising an underlying structural substrate having a first surface and a second surface, and a film of a compound containing a metal and a nonmetal, said film adhered to the first surface of the structural substrate.

BRIEF DESCRIPTION OF THE DRAWING

These and other objects and advantages of the present invention will become readily apparent upon consideration of the following detailed description and attached drawing, wherein.

DETAILED DESCRIPTION OF THE INVENTION

Figure 1:
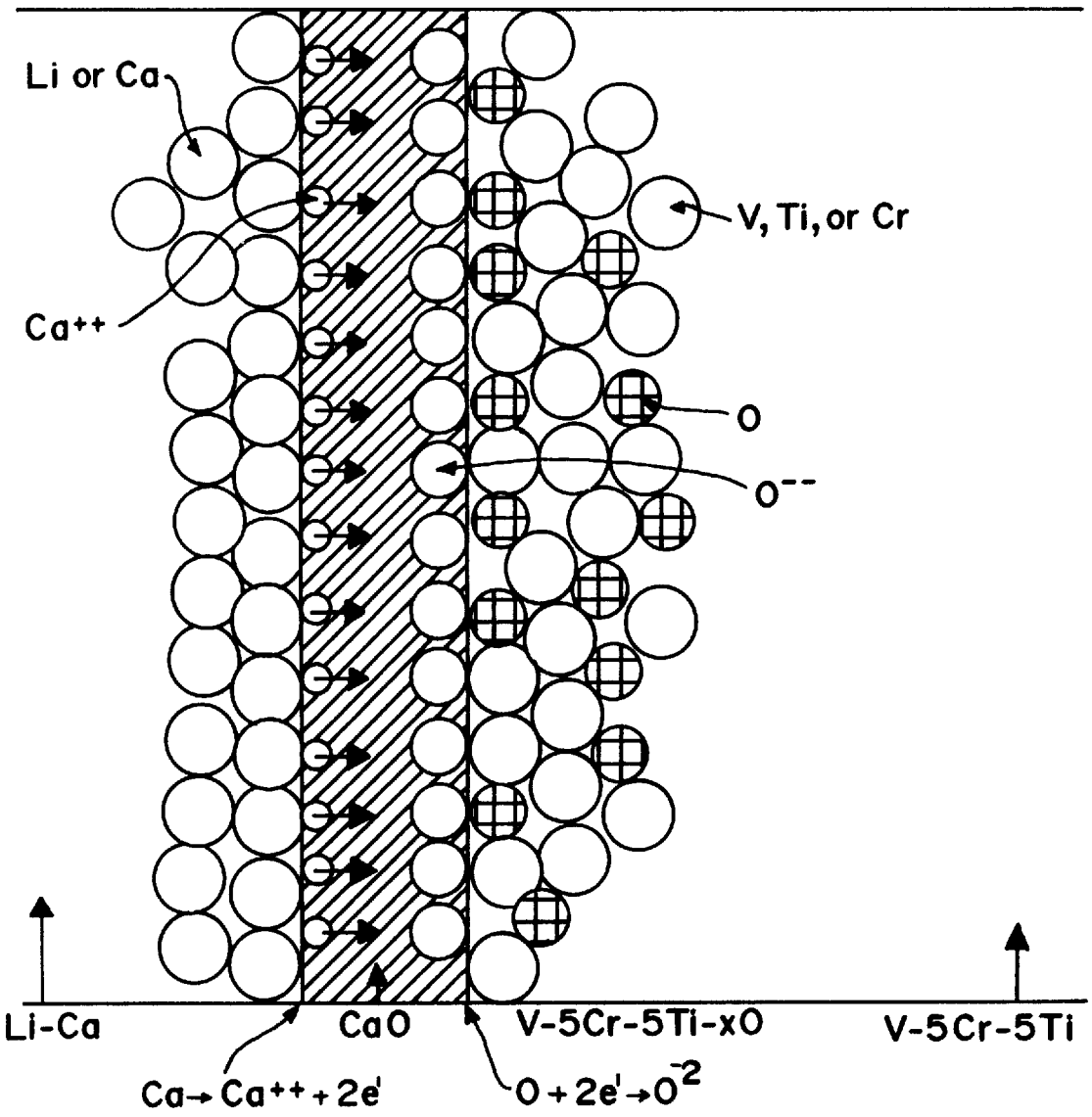
FIG. 1 is a schematic diagram of a surface permeated with a nonmetal, said FIG. 1 depicting cationic and anionic attraction between metal solutes and substrate surface dispersed anions, in accordance with the present invention.

Stable corrosion resistant electrical insulator coatings and a fabrication method to produce stable corrosion-resistant electrical insulator coatings at the liquid-metal/structural-material interface of high temperature liquid metal containment systems as been developed.

The inventor has converted intermetallic and anion-enriched substrate surfaces to electrically insulated coatings. The formation of metallided nitride coatings, such as AlN, and the formation of protective metal oxide coatings, such as CaO, in liquid metal coolant such as lithium, was repeatably demonstrated in the temperature range of 416° C. to 880° C. Metal oxide coatings, such as CaO formed relatively easily in molten metal spiked with the solute metal at 416° C.

The disclosed methods are economically viable in that the liquid metal coolant can be used over and over as only the solutes are consumed in the process.

The structural materials that can benefit from the invented method and coating include, but are not limited to, vanadium, vanadium-based alloys (such as V—Ti, V—Ti—Cr, V—Ti—Si,) titanium, stainless steel, molybdenum and niobium.

Use of Intermetallic Underlayments

In one method of producing insulator coatings, structural surfaces are first prepared by laying down, in situ, an intermetallic film over the structural surface. This film production occurs by exposing the surface to liquid metal coolant (such as lithium, lithium-lead, sodium, potassium, sodium-potassium, and gallium) containing dissolved metallic solutes (such as Al, Be, Ca, Cr, Fe, In, Mg, Ni, Pd, Pt, Si, Ti, and Y—Pt). The concentration of the solutes can range from between approximately 0.1 at % to 10 at %.

The use of liquid metal coolants as metal solute carriers assures even and rapid distribution due to their high wetting power and fluidity of the coolants. The intermetallic layer fabrication data, presented in Table 1, was produced using liquid lithium as the "solvent."

In the various intermetallic coating fabrication endeavors, aluminides, suicides, chrominides, Ca and Mg intermetallic layers formed on many of the structural specimens. Due to the solubility of the solutes in molten lithium, several metallides, such as the aluminides ($V_xAl_y$) were produced as intermetallic layers that contain more than 40–50 atom percent solute on structural alloys such as v-based alloys.

TABLE 1

Formation of Metallides[a] on Vanadium, Vanadium-base alloys, and stainless steels during exposure to Liquid Lithium Containing 3–5 at % of Several elements in Sealed Capsule Tests[b] at 700° C. for 234 hours.

| | Alloy Substrate | | | | | |
|---|---|---|---|---|---|---|
| Solute | V | V-5Ti | V-20Ti | V-5Cr-5Ti | V-15Cr-5Ti | SS |
| AI | – | – | – | + | ++ | ++ |
| Ca[c] | ++ | ++ | ++ | ++ | ++ | – |
| Si | + | + | + | + | ++ | ++ |
| Mg | + | + | + | + | + | ++ |
| Cr | + | + | + | + | + | ++ |
| Al-BN | – | – | – | + | + | ++ |
| Y-Pt[d] | Pt | Pt | Pt | Pt | Pt | Pt |

[a]Evaluation of coatings on specimen surfaces by electron-energy dispersive spectrum at a beam energy of 10–15 KeV. "–" indicates no coating present; "+" indicates fair amount of coating; "++" indicates extensive surface coverage.
[b]Tests conducted in Type 304 SS capsules under an argon (99.999%) atmosphere.
[c]More than 50% of the calcium found was in the form of CaO, which indicates oxygen diffusivity out of the substrate surface.
[d]Platinum coatings present on surfaces. Yttrium not detected.

The formation of aluminide coatings on vanadium and vanadium-alloys is typical with many structural materials and involves exposure of the structural material to liquid Li that contains 3–5 atom percent Al in sealed capsules comprised of the desired structural material, such as V and V-20Ti. Temperatures of the intermetallic layer fabrication process range from approximately 600° C. to 750° C.

Nitride and Oxide Insulative Coatings

After formation of the intermetallic layers, and based on thermodynamic considerations, nitride coatings on the layers can be produced via an M+MN (M=metal) delivery system, such as $Li+Li_3N$. Using lithium as an example, the mixture is two-phase with melting points of Li and $Li_3N$ at 180.6° C. and 815° C., respectively. The liquidus temperature of this Li—$Li_3N$ mixture increases monotonically as the nitrogen concentration increases to provide a means of establishing a fixed nitrogen partial pressure that corresponds to the thermodynamic equilibrium for the two-phase system.

The inventors have found through liquid-Li compatibility tests of coatings produced on V-based alloys that reactive intermetallic layers react with nitrogen contained in liquid metal coolant or by air oxidation under controlled conditions ranging in temperature of between approximately 400° C.–1000° C. When using nitrogen only, the method converted the intermetallic layers to electrically insulating nitride layers as the liquid Li reaction environ virtually eliminates surface contamination by O or oxide films. Concentrations of nitrogen in the liquid-Li delivery system can vary, but preferable concentrations are selected from the range of between approximately 3 to 5 at %. Oxide coatings are produced by reacting intermetallic layers with air at temperatures ranging from approximately 7500° C. to 1000° C. for 10 to 65 hours, Direct Oxidation or Nitridation Alternatively, instead of first coating the substrate surface with an intermetallic layer, oxide (such as CaO) or nitride (such as CaN) insulation coatings were produced by charging (in effect, nearly saturating) the surface region of a structural material (such as a vanadium based material) with a nonmetal such as carbon, oxygen, nitrogen, or sulfur. For example, the inventor found that by heat treating a structural substrate surface in flowing $N_2$ or Ar at temperatures of 510° C. to 1030° C., the surface was subsequently found to be rich in N or O, respectively. As illustrated in FIG. 1, this high permeability is due to an interstitial phenomenon whereby the nonmetal (an anion) is incorporated into the interstitial sublattice of the body-centered cubic crystal configuration of the structural materials. The desired effect is for the nonmetals to be present in the structural alloy as reactants so as to manifest their higher affinity for the solutes compared to the alloy's constituent elements.

Generally the thickness of the saturated surface can range from between approximately 3 microns ($\mu$m) to 300 $\mu$m. Often the entire substrate and not just the first 3–300 $\mu$m of the substrate is saturated or permeated with the nonmetal. Typical charging times range from 10–65 hours. Oxygen is applied to the system via an inert carrier gas such as Argon, Helium, Neon, Krypton or Xenon in concentrations ranging from 1–10 parts per million. Nitrogen is added neat. Carbides have been produced due to carbon presence resulting from traces of mineral oil in the lithium material used in the process, said oil used as lithium packing material.

As noted above, in those fabrication processes wherein the nonmetal is used to saturate the structural alloy, the dissolved solutes (e.g. Ca, Mg, or Al) react with the nonmetal diffusing from the substrate to produce the protective layer. Generally, the metal solutes are contained in the liquid Li in varying concentrations, depending on the temperature of the system. While these concentrations are readily discernable from solute/solvent phase diagrams, Table 2 below provides a range of solute to temperature guidelines for magnesium-based and calcium-based insulative layer systems fabricated in liquid lithium. Generally, preferable at % solute concentrations range from 1 at % to 40 at %. Preferable conversion rates of intermetallic or O and N enriched layers to an electrically insulating coating in liquid Li was demonstrated in the temperature range of between approximately 416° C. and 880° C.

TABLE 2

Proportion of Solute to Solvent concentrations for Mg and Ca in liquid-Lithium at various temperatures.

| Solute | % Solute | % Lithium | Temp. (C.) |
|---|---|---|---|
| Mg | 0 | 100 | 180 |
| Mg | 20 | 80 | 300 |
| Mg | 60 | 40 | 480 |
| Mg | 100 | 0 | 650* |
| Ca | 0 | 100 | 180 |
| Ca | 20 | 80 | 220 |
| Ca | 60 | 40 | 305 |
| Ca | 100 | 0 | 840* |

*Above 650° C. and 840° C., solute undergoes total melt.

The two coating fabrication methods disclosed above provide a variety of nitride-, oxide-, carbide-, and sulfide-based electrically insulative coatings, including, but not limited to, BN, $Y_2O_3$, CaO, BeO, MgO, $Li_2O$, $Al_2O_3$, TiO, VO, $V_2O_3$, TiN, $Be_3N_2$, AlN, $Mg_3N_2$, $Ca_3N_2$, $V_2N$ VN, $Li_3N$, CaVO, AlVN, TiVN, CaS, $Al_4C_3$, YAlO, $MgAl_2O_4$ and $In_2S_3$. The thicknesses of these protective layers range from approximately 100 angstroms (Å) to 30 μm.

Compatibility Screening

Certain oxides and nitrides are more compatible with certain liquid coolant systems. Exposure tests on electrically insulating ceramics in liquid-lithium systems reveal that the oxide- and nitride-layers produced by the invented method are stable in such harsh, high temperature environments. The results are shown in Table 3, below. Similar results are obtainable for other nitrides, such as CaN, MgN, BeN, VN, and various carbides and sulfides.

Generally, compatibility of ceramic insulators with liquid Li follows the criterion for thermodynamic stability, e.g., the more negative the Gibbs free energy, the more stable the oxide or nitride coating. Surprisingly and unexpectedly, the inventors found that while sintered AlN and SiC (applied by chemical vapor deposition) were not compatible with liquid Li in screening tests, due to for example the formation of unstable $Al_2O_3$ in the case of AlN, when the oxygen is gettered by the $Y/Y_2O_3$ phase present in AlN, sintered AlN remains intact after exposure to liquid Li. This compatibility of AlN and $Y_2O_3$ with liquid lithium systems is also illustrated in Table 3.

TABLE 3

Liquid-Li compatibility of insulator materials.

| Identity | Composition | [a]Compatibility/ Test Method | Observation |
|---|---|---|---|
| [b]TiN | [c]*TiN pure and doped (Si, Mg, Al) | 3/2 | TiN formed on Ti in liquid Li at 700° C. |
| [d]CaO | CaO | 3/2 | 700° C., 266 hrs. |

TABLE 3-continued

Liquid-Li compatibility of insulator materials.

| Identity | Composition | [a]Compatibility/ Test Method | Observation |
|---|---|---|---|
| | | | CaO formed on V-15Cr-5Ti |
| MgO | MgO | 3/2 | Intact |
| | MgO or Mg(V)O | 3/2 | 416° C. MgO or Mg(V)O formed in-situ on V-5Cr-5Ti in iquid Li |
| BeO | BeO | 3/2 | Intact |
| | BeO or Be(V)O | 3/1 and 2 | 416° C. BeO or Be(V)O formed in-situ on V-5Cr-5Ti in liquid Li |
| AlN | AlN | 3/2 | Intact |
| | AlN(1–3% Y) | 3/1 | Intact |
| | Al(V)N or AlN Al—O—C—N | 3/2 | AlN, Al(V)N, or Al—O—C—N formed in situ on V-5Cr-5Ti in liquid Li. |
| $Y_2O_3$ | $Y_2O_3$ | 3/2 | Intact |
| Yttrium-aluminum garnet | $Y_3Al_2O_{12}$ | 3/2 | Intact |

[a]Score 0 to 3: 0 indicates not compatible and 3 denotes compatible. Test method --1 indicates a test in flowing Li at 450° C. for 315 to 617 h; --2 denotes capsule tests at 400° C. for 100 h.
[b]TiN is an electrical conductor.
[c]Type 304/316 container bearing Li + N, and
[d]Li + Ca used for these samples.

Additionally, AlN also is a good insulator coating constituent for non-lithium devices, such as liquid sodium cooled systems.

EXAMPLE 1

AlN Coating on Aluminided V-5Cr-5Ti

An aluminide layer present on a V-5Cr-5Ti specimen was nitrided in an Li—$Li_3N$ mixture (≈3–5 at % N) in a system that also allowed measurement of electrical conductivity during formation of the AlN layer.

The coating area (surface of the tube in contact with Liquid Li) was 20 $cm^2$. Given a thickness of approximately one micron (1 μm), the electrical resistivity of 1.5 Ω at 700° C. is consistent with literature values for the alloy. Ohmic resistance dropped from the initial value to 0.43 Ω upon thermal cycling.

Formation of an AlN film on an aluminide layer follows the reaction $Li_3N+Al \longleftrightarrow 3Li+AlN$, whereby the free-energy change ΔG is −25 kcal/mole at 500° C. If the AlN film cracks or spalls, the ongoing reaction results in repairing the film, provided that N is present in the Li and the Al activity in the alloy is sufficient for spontaneous reaction to occur.

The limiting reagent in this reaction is N so that if N levels are low, then the AlN film may undergo dissolution, per the reaction $AlN \longleftrightarrow Al+N$. The ΔG for this reaction is +31.2 kcal/mole; therefore, the equilibrium constant K for the reaction at 500° C. is $K=2\times10^{-9}=a_{Al}\,a_N$, when the activities for Li and AlN are assumed to be unity. The typical impurity level for N in Li is ≈50–200 ppm. Therefore, the Al concentration in Li must be in the range of 10–40 ppm at 500° C. to maintain the AlN layer.

EXAMPLE 2

Nitride Coating on as-received V-5Cr-5Ti

Insulator coatings were produced on as-received (nonaluminided) V-5Cr-5 Ti by exposure of the alloy to liquid Li that contained 5 at. % N, with and without 5 at. % dissolved Al. The solute elements (N and Al) in the liquid Li reacted with the alloy substrate at 415° C. to produce thin adherent coatings.

The electrical resistance of the resulting insulator coatings was measured as a function of time at temperatures between 250° C. and 500° C. The resistance of the coating layer was≈1.5 Ω and 1.0 Ω at 415° C. and 500° C., respectively. Furthermore, thermal cycling between 250° C. and 415° C. did not change the resistance of the coating layers.

These results illustrate that thin homogenous coatings can be produced on various shaped surfaces by controlling the exposure time, temperature and composition of the liquid metal. The integrity of the coatings does not appear to be sensitive to defects (e.g., open pores, fissures, or microcracks) in the alloy substrate in liquid Li. The self-healing profile of the coating was determined by monitoring the resistance versus time in-situ in liquid Li. At 416° C., the dependence of ohmic resistance on time (i.e., self-healing of the film) followed parabolic behavior, where the rate constant is≈0.04 Ω/hour.

Figure 2:
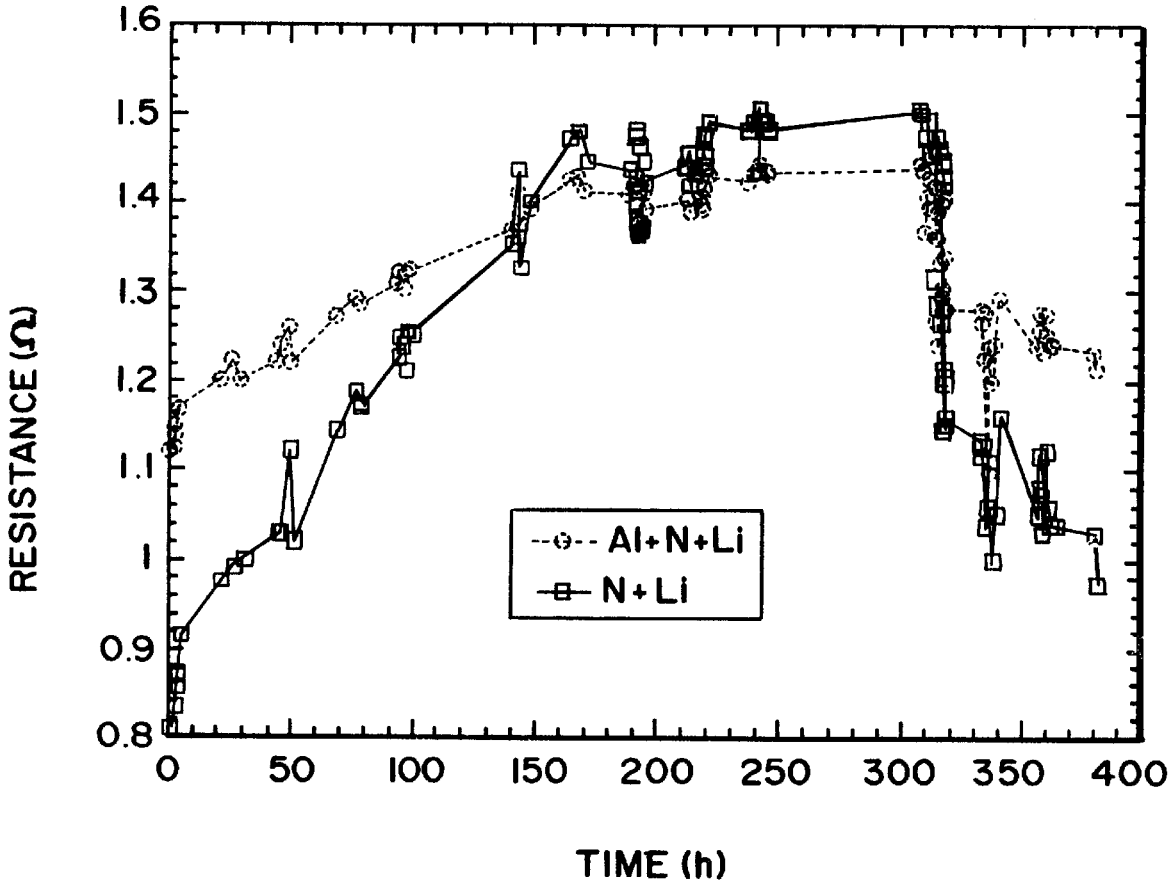
FIG. 2 is a graph showing ohmic resistance versus temperature for a nitride coating, in accordance with the features of the present invention.

The test conditions and results from in-situ electrical resistance of 150 $mm^2$ of V-5Cr-%Ti in contact with liquid Li are given in FIG. 2. Initially, the cell containing both Al and N exhibited higher ohmic values than did the cell containing only N, up until 150 hours after which the ohmic values of both cells were almost identical.

During thermal cycling between 415° C. and 250° C., the changes in resistance were small. This illustrates that the layers did not show degradation such as spallation or local defects. When the temperature increased from 415° C. to 500° C., the ohmic resistance dropped from≈1.5 Ω to 1.0 Ω for the Al-containing cell and from≈1.5 Ω to 0.95 Ω for the N-only containing cell.

While very thin coating layers produce lower resistivity values, as depicted in FIG. 2, the illustrated data shows that ohmic values for the coatings increase as a function of time. Therefore, this fabrication method can serve to repair insulative coatings (AlN or V,Ti—N) while the liquid-metal coolant system is operational. Furthermore, said coatings can be maintained at desired thicknesses in-situ by exploiting the thermodynamic relationship of the Li—$Li_3N$ system. For example, nitrogen concentrations can be maintained at certain levels by varying the concentration of the nonmetal in a cover gas, such as argon. Nitrogen concentrations ranging from 30 ppm to 4% in argon, and at temperatures ranging from 250° to 500° C., respectively, will produce good nitride layers.

Other underlying substrates are coated via this method. For example, the inventor nitrided titanium and titanium-alloy structural material by dissolving $Li_3N$ in liquid Li to allow the N to diffuse 2 5 into the Ti surface. Once the concentration of N in the surface was sufficiently high, the N and Ti reacted to form TiN.

EXAMPLE 3

$Al_2O_3$ Coating on Stainless Steels $Al_2O_3$ electrical insulator coatings were produced by air oxidation at 1000° C. for approximately 65 hours. First, aluminides were fabricated by exposing the structural substrate to liquid lithium containing 5 at % Aluminum in sealed capsules of V-20Ti at 650° C., 700° , and 750° C. for 247 hours under an argon (99.9990%) atmosphere. The V-alloy capsules were sealed in a type 316 stainless steel capsule to prevent oxidation. Good aluminide formation was also obtained on 304 SS and Molybdenum when exposed to liquid Li-5%Al at 775° C. for 31 hours in sealed capsules of 304 stainless steel under vacuum. Furthermore, good aluminide formation occurred on V, V-5Ti, V-20Ti, V-5Cr-5Ti, V-15Cr-5Ti, 304 stainless steel, and 316 stainless steel at 750° C. when said substrates were stainless steel under an argon (99.999%) atmosphere for 247 hours.

The aluminide layers were converted, via air oxidation, to electrically insulating oxide layers around the inside of Types 304 and 316 stainless steel tubes without spallation. The dissolved Li (≈100 ppm) which was used to facilitate aluminiding of the stainless steel may have helped to stabilize the $Al_2O_3$ coating layer during oxidation. $Al_2O_3$ coating layers were shown to be very good insulators ($10^6$ Ω to $10^{12}$ Ω) at temperatures ranging from 25° C. to 900° C. and also in non-Li metal coolant systems, such as liquid-sodium coolant systems.

EXAMPLE 4

Beryllium Coating on V-5Cr-5Ti

Beryllium forms intermetallic phases with many elements, namely Ba, C, Ca, Co, Cr, Cu, Fe, Hf, Ir, Mg, Mn, Mo, N, Nb, Ni, O, Po, Pt, Pu, Re, Rh, Ru, Sb, Sc, Se, Sr, Ta, Th, Ti, U,v, W, Y, Yb, and Zr. This property facilitates formation of Be—(V, Cr, Ti) intermetallic coatings on V—Cr—Ti alloys. Beryllium intermetallic coatings that form on structural alloys during exposure to liquid Li that contains dissolved Be can latter be nitrided or oxidized in the liquid-metal environment to produce stable electrical insulator layers, such as BeO, $Be_3N_2$, or Be—O—N.

Furthermore, Cr and Ti form $CrBe_2$ and $CrBe_{12}$ and $TiBe_2$, $TiBe_{12}$, and $TiBe_{17}$, respectively. Thus, it is evident that the major alloy constituents of V-5Cr-5Ti will form intermetallic phases with Be. Separately, intermetallic phases can also form when Fe—Cr-based alloys are exposed to liquid Li that contains dissolved Be.

The incorporation of Be as an intermetallic layer constituent is noteworthy, particularly as the relatively extremely small diameter of the resulting Be—N or Be—O complex (compared to CaO, for example) renders it a good neutron shielding material.

EXAMPLE 5

CaO Coating on V-5Cr-5Ti

Samples of V-5Cr-5Ti were heat treated in flowing $N_2$ or Ar (50 ppm trace $O_2$) at temperatures of 510° C. to 1030° C. to charge the surface of the alloy with N or O, respectively. Then the samples were immersed in Ca-bearing liquid Li (Li-4%Ca) for four days at 420° C. to investigate the formation of CaO.

The electrical resistance of the films was≈0.4 Ω at 267° C. to 3.5 Ω at 698° C. and decreased below 650° C., which is indicative of predominantly ceramic-insulator behavior. When direct current was supplied through the electrodes at 539° C., polarization behavior was observed and the ohmic values increased to 35.7 Ω for the 3 $cm^2$ area. Calculated resistance values of 107 Ω $cm^2$ will satisfy the required resistivity (ρ) times thickness (t) or ρt criterion of ≧25–100 Ω $cm^2$ for fusion reactor applications if the thickness is assumed to be ≈3 μm.

CaO coatings exhibit resistivity values of more than 36 Ω at more than 400° C.

While the invention has been described with reference to details of the illustrated embodiment, these details are not intended to limit the scope of the invention as defined in the appended claims.

The embodiment of the invention in which an exclusive property or privilege is claimed is defined as follows:

1. An in situ method for producing and maintaining an electrically insulating coating on a surface comprising:

selecting a surface from the group consisting of vanadium, vanadium-chromium-titanium alloy, titanium, vanadium-titanium alloy, molybdenum, stainless steel, and combinations thereof;

forming an intermetallic layer on the surface through contacting the surface with a liquid selected from the group consisting of lithium, lithium-lead, sodium, potassium, sodium-potassium, gallium, and combinations thereof, said liquid containing dissolved metals selected from the group consisting of Al, Be, Ca, Cr, Fe, In, Ni, Pd, Pt, Si, Ti, Y—Pt, and combinations thereof; and contacting the intermetallic layer with an alkali liquid containing dissolved molten metal-nonmetal compounds thereby forming an electrically insulating coating on the surface.

2. The method of claim 1 wherein the dissolved metal used to form the intermetallic layer has a concentration of between approximately 0.1 atom percent and 10 atom percent.

3. The method as recited in claim 1 wherein the step of contacting the intermetallic layer with a metal-nonmetal compound further consists of exposing the intermetallic layer to the metal-nonmetal compound at a temperature selected from the range of between approximately 400° C. and 1000° C.

4. The method of claim 1 wherein the metal of the metal-nonmetal compound is selected from a group consisting of Al, B, Be, Ca, Mg, Y and combinations thereof.

5. The method of claim 1 wherein the nonmetal of the metal-nonmetal compound is selected from a group consisting of oxygen, nitrogen, carbon, sulfur and combinations thereof.

6. An in situ method for producing and maintaining an electrically insulating coating on a surface comprising:

selecting a surface from the group consisting of vanadium, vanadium alloy and combinations thereof;

forming an intermetallic layer on the surface through contacting the surface with a molten alkali metal containing dissolved metals selected from the group consisting of Al, Be, Ca, Cr, Fe, In, Mg, Ni, Pd, Pt, Si, Ti, Y—Pt, and combinations thereof; and contacting the intermetallic layer with an alkali liquid containing dissolved molten metal-nonmetal compounds selected from the group consisting of metal nitrides, metal oxides and combinations thereof thereby forming an electrically insulating coating on the surface.

7. The method of claim 6 wherein the dissolved metal used to form the intermetallic layer has a concentration of between approximately 0.1 atom percent and 10 atom percent.

8. The method as recited in claim 6 wherein the step of contacting the intermetallic layer with a metal-nonmetal compound further consists of exposing the intermetallic layer to the metal-nonmetal compound at a temperature selected from the range of between approximately 400° C. and 1000° C.

9. The method of claim 1 wherein the metal of the metal-nonmetal compound is selected from a group consisting of Al, B, Be, Ca, Mg, Y and combinations thereof.

* * * * *